US011912316B2

(12) United States Patent
Meng et al.

(10) Patent No.: US 11,912,316 B2
(45) Date of Patent: Feb. 27, 2024

(54) VEHICLE COUPLER, COUPLER TONGUE AND COUPLER BODY

(71) Applicant: CRRC QIQIHAR ROLLING STOCK CO., LTD., Heilongjiang (CN)

(72) Inventors: Qingmin Meng, Heilongjiang (CN); Yingjun Cui, Heilongjiang (CN); Yan Wang, Heilongjiang (CN); Pengdi Jin, Heilongjiang (CN); Changchun Wang, Heilongjiang (CN); Shengguo Cong, Heilongjiang (CN)

(73) Assignee: CRRC QIQIHAR ROLLING STOCK CO., LTD., Heilongjiang (CN)

( * ) Notice: Subject to any disclaimer, the term of this patent is extended or adjusted under 35 U.S.C. 154(b) by 755 days.

(21) Appl. No.: 16/975,897

(22) PCT Filed: Jun. 26, 2019

(86) PCT No.: PCT/CN2019/092973
§ 371 (c)(1),
(2) Date: Aug. 26, 2020

(87) PCT Pub. No.: WO2020/001468
PCT Pub. Date: Jan. 2, 2020

(65) Prior Publication Data

US 2021/0001899 A1 Jan. 7, 2021

(30) Foreign Application Priority Data

Jun. 29, 2018 (CN) ..... 201810701432.3

(51) Int. Cl.
*B61G 3/06* (2006.01)

(52) U.S. Cl.
CPC ..... *B61G 3/06* (2013.01)

(58) Field of Classification Search
CPC ... B61G 1/00; B61G 1/02; B61G 1/10; B61G 3/02; B61G 3/04; B61G 3/06; B61G 3/22; B61G 3/24
See application file for complete search history.

(56) References Cited

U.S. PATENT DOCUMENTS 4,206,849 A 6/1980 Kaim
9,199,652 B1 12/2015 Brook et al.
(Continued)

FOREIGN PATENT DOCUMENTS

CN 102159348 A 8/2011
CN 201999008 U 10/2011
(Continued)

OTHER PUBLICATIONS

Examination Report dated May 4, 2021 for Australian Application No. 2019296795, 4 pages.
(Continued)

*Primary Examiner* — Robert J McCarry, Jr.
(74) *Attorney, Agent, or Firm* — Husch Blackwell

(57) ABSTRACT

A vehicle coupler, a coupler tongue and a coupler body. Upper traction platforms and lower traction platforms of the coupler tongue and the hook body are arranged in an offset manner in the horizontal direction, and the section R of a traction surface of the upper traction platform and the section S of a traction surface of the lower traction platform are obtained by sectioning the coupler tongue along any vertical surface across an axis of a pin hole; and the perpendicular distance between the point on the section R closest to a nock portion and the axis of the pin hole is k, and the perpendicular distance between the point on the section S closest to the neck portion and the axis of the pin hole is m, and as such, $n=|k-m|$, and 10 mm≤n≤125 mm.

10 Claims, 9 Drawing Sheets

(56) References Cited

U.S. PATENT DOCUMENTS

| | | | | |
|---|---|---|---|---|
| 2009/0289023 | A1 | 11/2009 | Marchese et al. | |
| 2011/0197461 | A1 | 8/2011 | Saeler | |
| 2011/0266242 | A1 | 11/2011 | Maxeiner et al. | |
| 2013/0206716 | A1 | 8/2013 | Burgoyne et al. | |
| 2015/0375762 | A1 | 12/2015 | Mautino et al. | |
| 2016/0288806 | A1* | 10/2016 | Manibharathi ..... | B61G 3/06 |
| 2020/0406940 | A1 | 12/2020 | Cui et al. | |

FOREIGN PATENT DOCUMENTS

| | | | |
|---|---|---|---|
| CN | 204548148 | U | 8/2015 |
| CN | 105109513 | A | 12/2015 |
| CN | 107873007 | A | 4/2018 |
| CN | 108528471 | A | 9/2018 |
| CN | 108583612 | A | 9/2018 |
| CN | 108839666 | A | 11/2018 |
| CN | 208453007 | U | 2/2019 |
| CN | 208582490 | U | 3/2019 |
| WO | WO 2009/003159 | | 11/2009 |
| WO | WO 2009/142750 | A1 | 11/2009 |
| WO | WO-2019142750 | A1 | 7/2019 |

OTHER PUBLICATIONS

Application and File history for U.S. Appl. No. 16/975,832, filed Aug. 26, 2020. Inventors: Cui et al.

International Search Report with English translation for PCT/CN2019/092974, dated Sep. 27, 2019, 13 pages.

Examination Report dated May 3, 2021 for Australian Application No. 2019296794, 4 pages.

International Search Report with English translation for PCT/CN2019/092973, dated Sep. 27, 2019, 13 pages.

First Office Action with English translation for CN priority application No. 201810701432.3, dated Apr. 3, 2019, 9 pages.

* cited by examiner

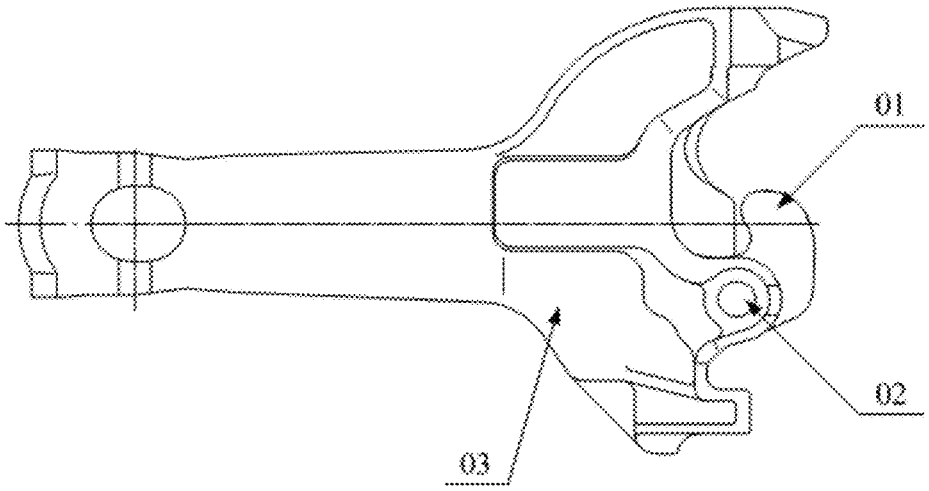
Figure 1 - Prior Art
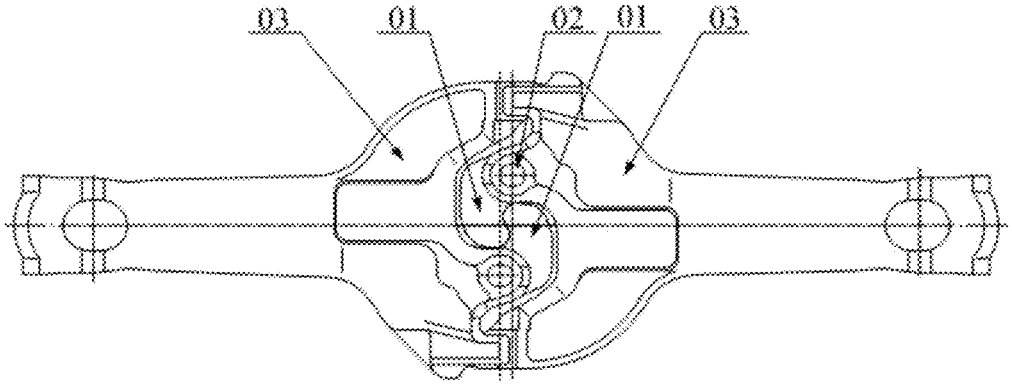
Figure 2 - Prior Art
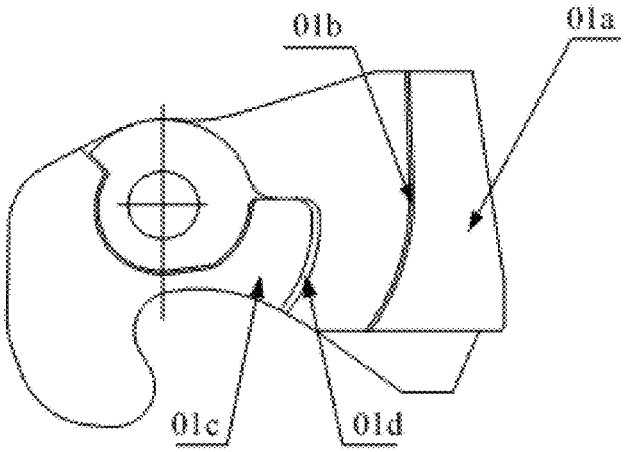
Figure 3 - Prior Art

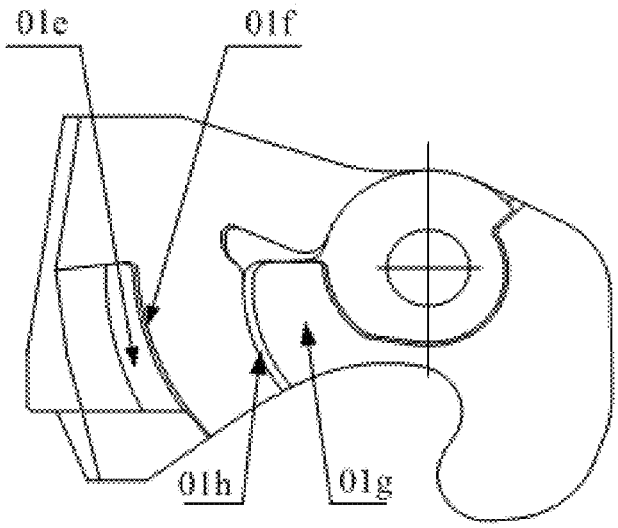
Figure 4 - Prior Art
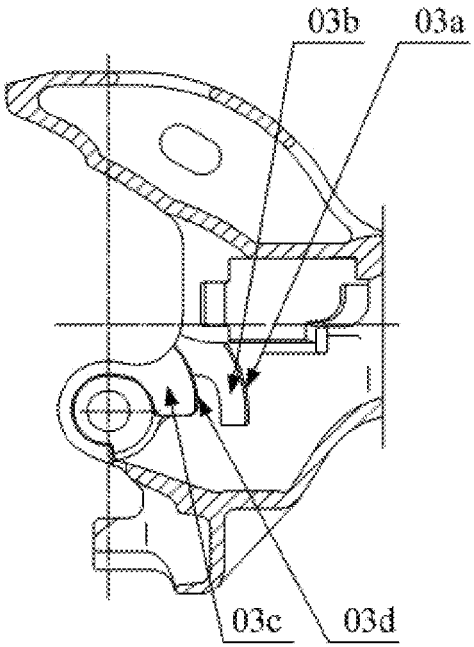
Figure 5 - Prior Art

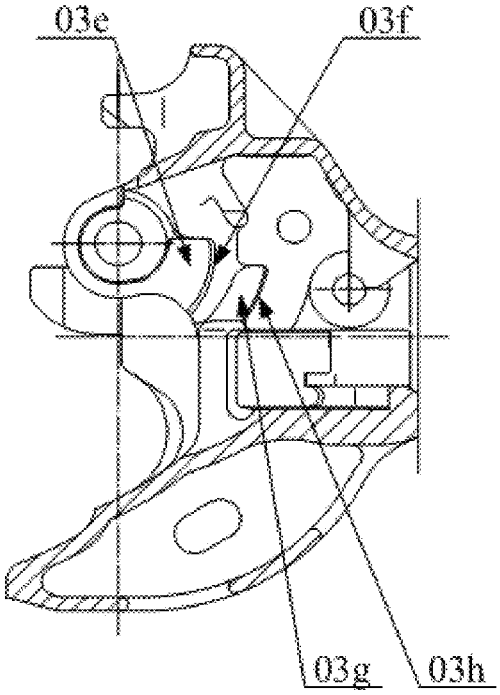
Figure 6 - Prior Art
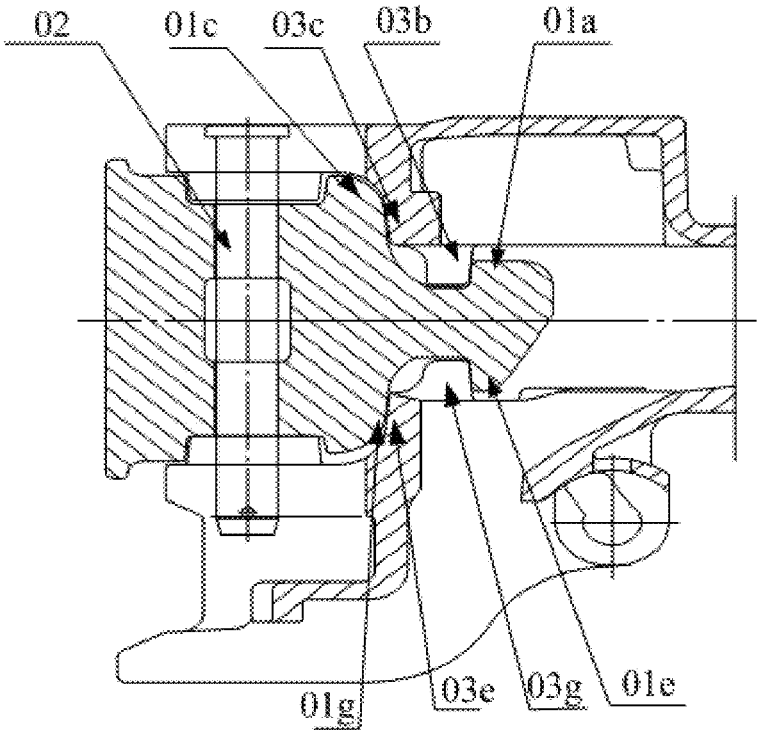
Figure 7 - Prior Art

VEHICLE COUPLER, COUPLER TONGUE AND COUPLER BODY

FIELD

The present application is the national phase of international application No. PCT/CN2019/092973, titled "VEHICLE COUPLER, COUPLER TONGUE AND COUPLER BODY", filed on Jun. 26, 2019, which the priority to Chinese Patent Application No. 201810701432.3, titled "VEHICLE COUPLER, COUPLER TONGUE AND COUPLER BODY", filed with the China National Intellectual Property Administration on Jun. 29, 2018, both of which are incorporated herein by reference.

FIELD

The present application relates to the technical field of railway transportation, and in particular to a coupler, a coupler knuckle and a coupler body thereof.

BACKGROUND

The coupler is one of the most basic and most important parts of the railway vehicle. It is installed at two ends of the vehicle and is used to connect two adjacent vehicles and transmit the longitudinal force of the train. There are many kinds of couplers, but the most widely used coupler is articulated coupler. As shown in FIG. 1, an articulated coupler includes a coupler body 03, a coupler knuckle 01, a coupler lock, a coupler knuckle push member, a coupler knuckle pin 02 and other components. The coupler knuckle 01 is rotatable around the coupler knuckle pin 02 to realize opening and locking of the coupler. The main load-bearing parts inside the coupler are a traction platform of the coupler knuckle 01 and a traction platform of the coupler body 03. As shown in FIG. 2, two couplers are hitched to connect two adjacent vehicles.

At present, as shown in FIGS. 3 to 4, the coupler knuckle 01 is provided with an upper traction platform, a lower traction platform, an upper impact platform and a lower impact platform. As shown in FIGS. 5 and 6, the coupler body is provided with an upper traction platform, a lower traction platform, an upper impact platform, and a lower impact platform. As shown in FIG. 7, when the coupler knuckle is engaged with the coupler body, the upper traction platform 01*a* of the coupler knuckle abuts against the upper traction platform 03*b* of the coupler body, the lower traction platform 01*e* of the coupler knuckle abuts against the lower traction platform 03*g* of the coupler body, an upper impact platform 01*c* of the coupler knuckle abuts against an upper impact platform 03*c* of the coupler body, and a lower impact platform 01*g* of the coupler knuckle abuts against the lower impact platform 03*e* of the coupler body. And then, an upper traction surface 01*b* of the coupler knuckle contacts and abuts against an upper traction surface 03*a* of the coupler body, a lower traction surface 01*f* of the coupler knuckle contacts and abuts against a lower traction surface 03*h* of the coupler body, and an upper impact surface Old of the coupler knuckle contacts and abuts against an upper impact surface 03*d* of the coupler body, and a lower impact surface 01*h* of the coupler knuckle contacts and abuts against the lower impact surface 03*f* of the coupler body, so as to realize that the upper and lower traction platforms bear the tensile load and the upper and lower impact platforms bear the compression load.

It can be seen from FIG. 7 that the upper and lower traction surfaces of the coupler knuckle are arranged side by side along the vertical direction, and the upper and lower traction surfaces of the coupler body are also arranged side by side along the vertical direction. That is, sections of the upper and lower traction surfaces obtained by sectioning the coupler knuckle along the vertical direction are equidistant from the axis of a pin hole on the coupler knuckle. Similarly, sections of the upper and lower traction surfaces obtained by sectioning the coupler body along the vertical direction are equidistant from the axis of the pin hole on the coupler body, and the roots of the upper and lower traction platforms of the coupler knuckle and the coupler body are subjected to greater stress. In this way, the upper and lower traction surfaces of the coupler knuckle and the coupler body are in a same vertical plane, which deteriorates the stress state of the root sections of the upper and lower traction platforms of the coupler knuckle and the coupler body, and is more likely to cause fracture, reduces the service life of the coupler knuckle, increases the replacement and maintenance cost of the coupler, and affects the running safety of the train.

In summary, how to effectively prolong the service life of the coupler knuckle and reduce the maintenance cost of the coupler is an urgent problem to be solved by those skilled in the art.

SUMMARY

In view of this, a first object of the present application is to provide a coupler knuckle and a coupler body whose structural designs can effectively prolong the service life of the coupler knuckle and reduce the maintenance cost of the coupler. A second object of the present application is to provide a coupler including the coupler knuckle and the coupler body.

In order to achieve the first object, the following technical solutions are provided according to the present application.

A coupler knuckle includes an upper traction platform, a lower traction platform, an upper impact platform, a lower impact platform, a pin hole and a neck portion. A section R of a traction surface of the upper traction platform and a section S of a traction surface of the lower traction platform are obtained by sectioning the coupler knuckle along any vertical plane passing through an axis of the pin hole.

A perpendicular distance between a point on the section R closest to the neck portion and the axis of the pin hole is defined as k, and a perpendicular distance between a point on the section S closest to the neck portion and the axis of the pin hole is defined as m, and $n=|k-m|$ and $10\ mm \le n \le 25\ mm$.

Preferably, in the coupler knuckle, an included angle between the section R and the vertical plane is defined as $\alpha$, and $5° \le \alpha \le 15°$; and an included angle between the section S and the vertical plane is defined as $\beta$, and $5° \le \beta \le 15°$.

Preferably, in the coupler knuckle, the traction surface of the upper traction platform tilts away from the upper impact platform in a direction gradually away from the neck portion; and the traction surface of the lower traction platform tilts away from the lower impact platform in a direction gradually away from the neck portion.

Preferably, in the coupler knuckle, a distance in the horizontal direction between a point on the traction surface of the upper traction platform closest to a coupler tip and closest to the neck portion and a point on an impact surface of the upper impact platform closest to the coupler tip and closest to the neck portion is defined as p; and a distance in the horizontal direction between a point on a traction surface of the lower traction platform closest to the coupler tip and closest to the neck portion and a point on an impact surface of the lower impact platform closest to the coupler tip and closest to the neck portion is defined as q, and $p<q$.

Preferably, in the coupler knuckle, the traction surface of the upper traction platform and/or the traction surface of the lower traction platform is divided into a contact area and an avoidance area along a direction of approaching a lock surface of the coupler knuckle, an extension surface of one end of the contact area close to the lock surface is defined as M1, and the avoidance area is located on one side of the M1 surface away from the pin hole.

A coupler body includes an upper traction platform, a lower traction platform, an upper impact platform, a lower impact platform, a pin hole and a lock chamber. A section T of a traction surface of the upper traction platform and a section U of a traction surface of the lower traction platform are obtained by sectioning the coupler body along any vertical plane passing through an axis of the pin hole.

A perpendicular distance between a point on the section T farthest from the lower traction platform and the axis of the pin hole is defined as k0, and a perpendicular distance between a point on the section U farthest from the upper traction platform and the axis of the pin hole is defined as m0, and $n0=|k0-m0|$, and $10\ mm \leq n0 \leq 25\ mm$.

Preferably, in the coupler body, an included angle between the section T and the vertical plane is defined as $\alpha 0$, and $5° \leq \alpha 0 \leq 15°$; and an included angle between the section U and the vertical plane is defined as $\beta 0$, and $5° \leq \beta 0 \leq 15°$.

Preferably, in the coupler body, a distance in the horizontal direction between one end of the traction surface of the upper traction platform closest to the root of the upper traction platform and one end of the impact surface of the upper impact platform close to the root of the upper traction platform is defined as p1; and a distance in the horizontal direction between one end of the traction surface of the lower traction platform closest to the root of the lower traction platform and one end of the impact surface of the lower impact platform close to the root of the lower traction platform is defined as q1, and $p1<q1$.

Preferably, in the coupler body, the traction surface of the upper traction platform and/or the traction surface of the lower traction platform is divided into an abutting area and a non-abutting area along a direction of approaching the lock chamber of the coupler body, an extension surface of one end of the abutting area close to the lock chamber is defined as M2, and the non-abutting area is located on one side of the M2 surface close to the pin hole.

A coupler includes a coupler knuckle and a coupler body, wherein the coupler body is the coupler body described in any one of the above.

In the coupler knuckle provided by the present application, the upper traction platform and the lower traction platform of the coupler knuckle are misaligned in the horizontal direction, thereby avoiding the situation where heads of the upper traction platform and the lower traction platform of the coupler knuckle are located in the same vertical plane. The heads of the upper traction platform and the lower traction platform are both weak portions in the large stress zone. Therefore, weak portions in the large stress zone of the upper and lower traction platforms of the coupler knuckle are misaligned, greatly reducing the stress of the upper and lower traction platforms. In addition, the misalignment between the upper traction platform and the lower traction platform is within a range of 5 mm to 25 mm, and the misalignment is more reasonable, such that the traction platform and the impact platform are not too close in terms of distance, thus avoiding the deterioration of the stress state of this portion caused by the structural abrupt change between the traction platform and the impact platform of the coupler knuckle. In conclusion, the coupler knuckle provided by the present application can reduce the stress, avoid the problem that the upper and lower traction platforms break prematurely, prolong the service life of the coupler knuckle, reduce the maintenance cost, and improve transportation safety and reliability.

In the coupler body provided by the present application, the upper traction platform and the lower traction platform of the coupler body are misaligned in the horizontal direction, thereby avoiding the situation where roots of the upper traction platform and the lower traction platform of the coupler body are located in the same vertical plane. The roots of the upper traction platform and the lower traction platform are both weak portions in the large stress zone. Therefore, weak portions in the large stress zone of the upper and lower traction platforms of the coupler body are misaligned, greatly reducing the stress of the upper and lower traction platforms. In addition, the misalignment between the upper traction platform and the lower traction platform is within a range of 5 mm to 25 mm, and the misalignment is more reasonable, such that the traction platform and the impact platform are not too close in terms of distance, thus avoiding the deterioration of the stress state of this portion caused by the structural abrupt change between the traction platform and the impact platform of the coupler body. In conclusion, the coupler body provided by the present application can reduce the stress, avoid the problem that the upper and lower traction platforms break prematurely, prolong the service life of the coupler body, reduce the maintenance cost, and improve transportation safety and reliability.

In order to achieve the second object, a coupler is further provided by the present application, which includes the coupler knuckle and the coupler body described in any one of the above. Since the coupler knuckle and the coupler body have the above technical effects, the coupler having the coupler knuckle and the coupler body accordingly has the same technical effects.

BRIEF DESCRIPTION OF THE DRAWINGS

For more clearly illustrating embodiments of the present application or technical solutions in the conventional technology, the drawing referred to for describing the embodiments or the conventional technology will be briefly described hereinafter. Apparently, the drawings in the following description are only some examples of the present application, and for those skilled in the art, other drawings may be obtained based on the provided drawings without any creative efforts.

FIG. 1 is a schematic structural view of a single coupler in the prior art;

FIG. 2 is a schematic view showing two couplers in a hitched state in the prior art;

FIG. 3 is a top view of a coupler knuckle in the prior art;

FIG. 4 is a bottom view of the coupler knuckle in the prior art;

FIG. 5 is a sectional view of a coupler body in the prior art;

FIG. 6 is another sectional view of the coupler body in the prior art;

FIG. 7 is a sectional view showing the engagement of the coupler knuckle and the coupler body in the prior art;

Figure 8:
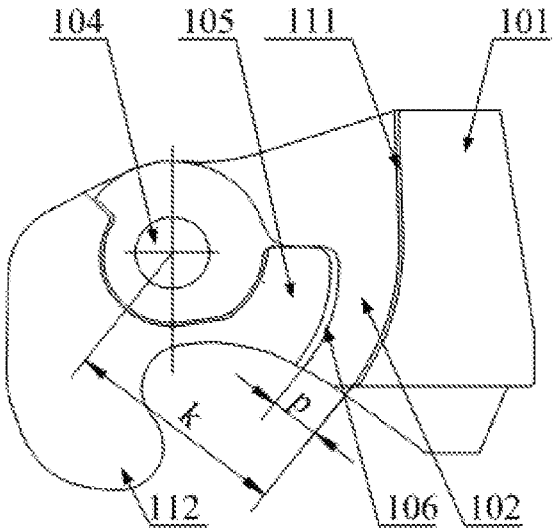
FIG. 8 is a top view of a coupler knuckle provided by an embodiment of the present application.

Reference Numerals in FIGS. 1 to 7 are listed as follows:

01 coupler knuckle,
01a upper traction platform of coupler knuckle,
01b upper traction surface of coupler knuckle,
01c upper impact platform of coupler knuckle,
01d upper impact surface of coupler knuckle,
01e lower traction platform of coupler knuckle,
01f lower traction surface of coupler knuckle,
01g lower impact platform of coupler knuckle,
01h lower impact surface of coupler knuckle,
02 coupler knuckle pin,
03 coupler body,
03a upper traction surface of coupler body,
03b upper traction platform of coupler body,
03c upper impact platform of coupler body,
03d upper impact surface of coupler body,
03e lower impact platform of coupler body,
03f lower impact surface of coupler body,
03g lower traction platform of coupler body,
03h lower traction surface of coupler body;

Reference numerals in FIGS. 8 to 19 are listed as follows:

101 upper traction platform of coupler knuckle,
102 neck portion,
104 pin hole of coupler knuckle,
105 upper impact platform of coupler knuckle,
106 upper impact surface of coupler knuckle,
107 lower impact surface of coupler knuckle,
108 lower traction platform of coupler knuckle,
110 lower impact platform of coupler knuckle,
111 upper traction surface of coupler knuckle,
111a contact area,
111b avoidance area,
112 coupler tip,
113 lower traction surface of coupler knuckle,
115 lock surface,
116 coupler knuckle pin;
201 upper traction platform of coupler body,
202 upper impact surface of coupler body, -continued 204 pin hole of coupler body,
205 lower traction platform of coupler body,
206 lower impact surface of coupler body,
208 lower traction surface of coupler body,
209 lock chamber,
210 upper traction surface of coupler body,
211 upper impact platform of coupler body,
211a abutting area,
211b non-abutting area,
212 lower impact platform of coupler body.

DETAILED DESCRIPTION OF EMBODIMENTS

A first object of the present application is to provide a coupler knuckle and a coupler body whose structural designs can effectively prolong the service life of the coupler knuckle and reduce the maintenance cost of the coupler. A second object of the present application is to provide a coupler including the coupler knuckle and the coupler body.

The technical solutions in the embodiments of the present application will be described clearly and completely hereinafter in conjunction with the drawings in the embodiments of the present application. The described embodiments are only a part of the embodiments of the present application, rather than all embodiments. Based on the embodiments in the present application, all of other embodiments, made by the person skilled in the art without any creative efforts, fall into the scope of the present application.

In the description of the present application, it should be understood that an orientation or a position relation indicated by terms "upper", "lower", "front", "rear", "left", "right" or the like is described based on an orientation or a position relation shown in the drawings, and is only used for describing the present application and simplifying the description, rather than instructing or implying that a device or element related to the terms must have a specific orientation or be constructed and operated in a specific orientation. Therefore, the terms should be not construed as limitations of the present application. In addition, the terms "first", "second" and the like are for purpose of description, and should not be construed as indicating or implying relative importance.

Figure 9:
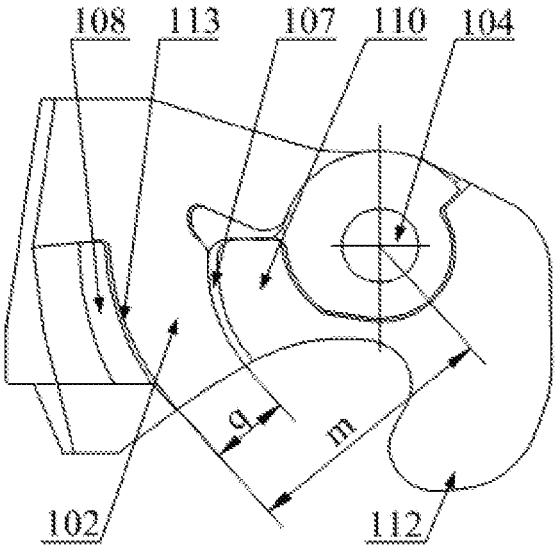
FIG. 9 is a bottom view of the coupler knuckle provided by an embodiment of the present application.
Figure 10:
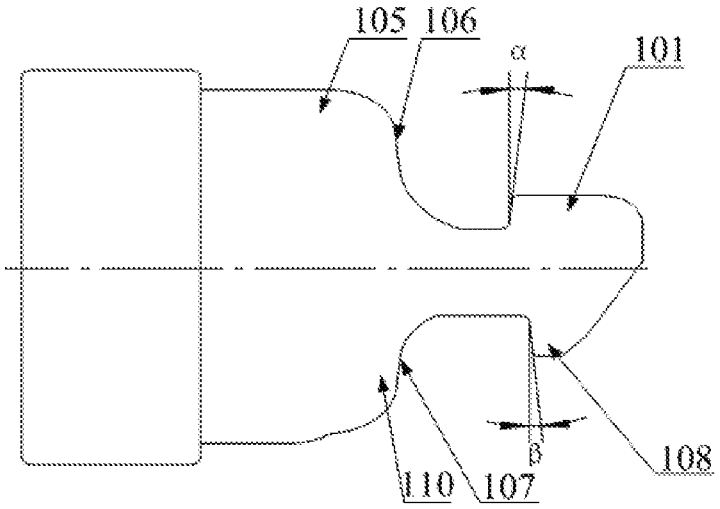
FIG. 10 is a sectional view taken along a vertical plane of the coupler knuckle provided by an embodiment of the present application.

Referring to FIGS. 8 to 10, FIGS. 8 to 10 show the structure of the coupler knuckle. The coupler knuckle provided by the embodiment of the present application includes an upper traction platform 101, a lower traction platform 108, an upper impact platform 105, a lower impact platform 110, a pin hole 104, and a neck portion 102, wherein the pin hole 104 is configured to allow a coupler knuckle pin to pass through. The neck portion 102 of the coupler knuckle is located between the upper and lower traction platforms 108 and the upper and lower impact platforms 110. When the coupler knuckle is engaged with the coupler body, the neck portion 102 of the coupler knuckle is located between the upper and lower traction platforms 108 of the coupler body.

The point is that, a section R of a traction surface of the upper traction platform 101 and a section S of a traction surface of the lower traction platform 108 are obtained by sectioning the coupler knuckle along any vertical plane passing through an axis of the pin hole 104, and the section R and section S herein are both lines. The traction surface of the upper traction platform 101 is the upper traction surface 111, and the traction surface of the lower traction platform 108 is the lower traction surface 113. That is, when the coupler knuckle is sectioned along the vertical plane, the vertical plane needs to pass through the axis of the pin hole 104, the upper traction surface 111 and the lower traction surface 113 of the coupler knuckle at the same time so as to obtain the section R and the section S.

A perpendicular distance between a point on the section R closest to the neck portion 102 and the axis of the pin hole 104 is defined as k, and a perpendicular distance between a point on the section S closest to the neck portion 102 and the axis of the pin hole 104 is defined as m, and $n=|k-m|$, and $10\ mm \le n \le 25\ mm$. The point closest to the neck portion 102 is a point on the section R or the section S with the minimum distance from the neck portion 102. It should be noted that, in a case that the upper traction surface 111 and the lower traction surface 113 are connected with the neck portion 102 through a smooth transition surface, the distance between a joint of the upper traction surface 111 and the smooth transition surface and the neck portion 102 is the smallest, that is, a connection point of the section R and a section of the smooth transition surface is closest to the neck portion 102. Similarly, the distance between a joint of the lower traction surface 113 and the smooth transition surface and the neck portion 102 is the smallest, that is, a connection point of the section S and a section of the smooth transition surface is closest to the neck portion 102.

In the above embodiment, whether $k>m$, or $k<m$ is applicable, which is not limited herein.

Or, in other words, a perpendicular distance between a lower end point of the section R and the axis of the pin hole 104 is defined as k, and a perpendicular distance between an upper end point of the section S and the axis of the pin hole 104 is defined as m, and $n=|k-m|$, and $10\ mm \le n \le 25\ mm$. In each embodiment, the upper and lower directions are the same as those during the normal use of the coupler knuckle.

In the coupler knuckle provided by the embodiment of the present application, the upper traction platform 101 and the lower traction platform 108 of the coupler knuckle are misaligned in the horizontal direction, thereby avoiding the situation where heads of the upper traction platform 101 and the lower traction platform 108 of the coupler knuckle are located in the same vertical plane. The heads of the upper traction platform 101 and the lower traction platform 108 are both weak portions in the large stress zone. Therefore, weak portions in the large stress zone of the upper traction platform 101 and the lower traction platform 108 of the coupler knuckle are misaligned, greatly reducing the stress of the upper and lower traction platforms 108. In addition, the misalignment between the upper traction platform 101 and the lower traction platform 108 is within a range of 5 mm to 25 mm, and the misalignment is more reasonable, such that the traction platform and the impact platform are not too close in terms of distance, thus avoiding the deterioration of the stress state of this portion caused by the structural abrupt change between the traction platform and the impact platform of the coupler knuckle. In conclusion, the coupler knuckle provided by the embodiment of the present application can reduce the stress, avoid the problem that the upper and lower traction platforms 108 break prematurely, prolong the service life of the coupler knuckle, reduce the maintenance cost, and improve transportation safety and reliability.

In a specific embodiment, an included angle between the section R and the vertical plane is defined as $\alpha$, and $5° \le \alpha \le 15°$. An included angle between the section S and the vertical plane is defined as $\beta$, and $5° \le \beta \le 15°$. That is, the upper traction surface 111 and the lower traction surface 113 are inclined relative to the vertical plane. An inclination angle of the upper traction surface 111 relative to the vertical plane is $\alpha$, and an inclination angle of the lower traction surface 113 relative to the vertical plane is $\beta$. The values of $\alpha$ and $\beta$ may be the same or different, which will not be limited herein.

Further, the traction surface of the upper traction platform 101 tilts away from the upper impact platform 105 in a direction gradually away from the neck portion 102, that is, the upper traction surface 111 extends gradually away from the upper impact platform 105 in an upward direction. The traction surface of the lower traction platform 108 tilts away from the lower impact platform 110 in a direction gradually away from the neck portion 102, that is, the lower traction surface 113 extends gradually away from the lower impact platform 110 in a downward direction. In the present embodiment, by arranging mating surface angles of the upper traction surface 111 and the lower traction surface 113 of the coupler knuckle more reasonable, the stress level of the upper and lower traction platforms 108 is reduced, the structural strength of the upper and lower traction platforms 108 of the coupler knuckle is improved, the premature fracture of the traction platforms of the coupler knuckle is avoided, and the service life of the coupler knuckle and the coupler body is prolonged.

Apparently, the traction surface of the upper traction platform 101 may tilt toward the upper impact platform 105 in a direction gradually away from the neck portion 102, and the traction surface of the lower traction platform 108 may tilt toward the lower impact platform 110 in a direction gradually away from the neck portion 102. Or, the upper traction surface 111 and the lower traction surface 113 may both be vertical surfaces, which are not limited herein.

In another specific embodiment, a distance in the horizontal direction between a point on the traction surface of the upper traction platform 101 closest to a coupler tip 112 and closest to the neck portion 102 and a point on the impact surface of the upper impact platform 105 closest to the coupler tip 112 and closest to the neck portion 102 is defined as p. That is, a point on the upper traction surface 111 closet to the coupler tip 112 and closest to the neck portion 102 is a point V, and the point V is a lower end point of a side, close to the coupler tip 112, of the upper traction surface 111; and a point on the upper impact surface 106 closet to the coupler tip 112 and closest to the neck portion 102 is a point W, and the point W is a lower end point of a side, close to the coupler tip 112, of the upper impact surface 106. The distance between projections of the point V and the point W on a same horizontal plane is defined as p.

A distance in the horizontal direction between a point on the traction surface of the lower traction platform 108 closest to the coupler tip 112 and closest to the neck portion 102 and a point on the impact surface of the lower impact platform 110 closest to the coupler tip 112 and closest to the neck portion 102 is defined as q, and $p<q$. That is, a point on the lower traction surface 113 closet to the coupler tip 112 and closest to the neck portion 102 is a point X, and the point X is an upper end point of a side, close to the coupler tip 112, of the lower traction surface 113; and a point on the lower impact surface 107 closet to the coupler tip 112 and closest to the neck portion 102 is a point Y, and the point Y is an upper end point of a side, close to the coupler tip 112, of the lower impact surface 107. The distance between projections of the point X and the point Y on a same horizontal plane is defined as q, and $p<q$. With such an arrangement, the reduction of a wall thickness of the traction platform and the reduction of the structural strength of the traction platform due to the reduction of the distance between the traction platform and the impact platform of the coupler knuckle can be avoided, and the structural strength of a portion between the traction platform and the impact platform of the coupler knuckle can be ensured.

The coupler knuckle provided by the embodiment of the present application includes an upper traction platform 101, a lower traction platform 108, a lock surface 115 and a pin hole 104, wherein the lock surface 115 is configured to abut against a coupler lock to prevent the coupler knuckle from rotating around the coupler knuckle pin 116, and the pin hole 104 is configured to allow the coupler knuckle pin 116 to pass through. The point is that a traction surface of the upper traction platform 101 and/or the lower traction platform 108 is divided into contact area 111*a* and an avoidance area 111*b* along a direction of gradually approaching the lock surface 115. That is, the traction surface of at least one of the upper traction platform 101 and the lower traction platform 108 is divided into the contact area 111*a* and the avoidance area 111*b*, and the avoidance area 111*b* is located between the contact area 111*a* and the lock surface 115, that is, the traction surface is sequentially divided into the contact area 111*a* and the avoidance area 111*b* along the direction of gradually approaching the lock surface 115.

In addition, an extension surface of one end of the contact area 111*a* close to the lock surface 115 is defined as M1, and the avoidance area 111*b* is located on one side of the M1 surface close to the pin hole 104. If a first end of the contact area 111*a* is connected with the avoidance area 111*b*, the M1 surface is the extension surface of the first end of the contact area 111*a*, and the avoidance area 111*b* is located between the M1 surface and the pin hole 104. When the coupler knuckle is in normal use, a section of the M1 surface, a section of the contact area 111*a* and a section of the avoidance area 111*b* are obtained by sectioning the coupler body along the horizontal plane. The section of the M1 surface is an extension line of the section of the contact area 111*a*, and the section of the avoidance area 111*b* is located between the section of the M1 surface and a section of the pin hole 104.

It should be noted that the above-mentioned pin hole 104 and the lock surface 115 are the same as those of the coupler knuckle in the prior art. The pin hole 104 is located on a side, close to the coupler tip of the coupler knuckle, of the upper traction platform 101 and the lower traction platform 108.

When the coupler knuckle and the coupler body provided by the embodiment of the present application are engaged, the traction surface of the upper traction platform 101 of the coupler knuckle contacts and abuts against a traction surface of an upper traction platform 201 of the coupler body, and the traction surface of the lower traction platform 108 of the coupler knuckle contacts and abuts against a traction surface of a lower traction platform 205 of the coupler body, and the traction platform of the coupler body is located at one side of the corresponding traction platform of the coupler knuckle close to the pin hole 104. As the upper traction platform 101 and/or the lower traction platform 108 of the coupler knuckle is provided with the avoidance area 111*b* which is located at one side of the extension surface of the contact area 111*a* away from the pin hole 104, a gap is provided between the avoidance area 111*b* of the traction surface of the upper traction platform 101 and/or the lower traction platform 108 of the coupler knuckle and the traction surface of the corresponding traction platform of the coupler body, and the avoidance area and the traction surface of the corresponding traction platform of the coupler knuckle cannot contact each other, when the coupler knuckle provided by the embodiment of the present application is engaged with the coupler body. Meanwhile, the contact area 111*a* of the traction surface of the upper traction platform 101 and/or the lower traction platform 108 of the coupler knuckle and the traction surface of the corresponding traction platform of the coupler body are in close contact with each other without a gap.

With this arrangement, since the avoidance area 111*b* is located between the contact area 111*a* and the lock surface 115 and a gap is provided between the avoidance area 111*b* and the traction platform of the coupler knuckle and the two are not in contact with each other, the distance from the edge of the contact area between the upper traction platform 101 and/or the lower traction platform 108 of the coupler knuckle and the traction platform of the coupler body to the lock surface 115 is increased, and the distance from the engagement contact bearing position of the coupler body and the coupler knuckle to the lock surface 115 and the lock chamber is increased, so that the engagement contact bearing position of the coupler body and the coupler knuckle gets away from the structural abrupt change area, thereby reducing the stress level of the upper and lower traction platforms of the coupler body and the coupler knuckle, avoiding the problem that the traction platforms of the coupler body and the coupler knuckle break prematurely, prolonging the service life of the coupler body and the coupler knuckle, and reducing the maintenance cost of the coupler.

In order to prevent dislocation when the coupler knuckle is engaged with the coupler body, the contact area 111*a* may be a curved surface, and similarly, the area, cooperating with the contact area, on the traction surface of the traction platform of the coupler body may be a curved surface as well. The coupler body and the coupler knuckle can be prevented from sliding relative to each other and from shifting and dislocation.

In addition, the contact area 111*a* may be an arc surface. Specifically, the contact area 111*a* may protrude away from the pin hole 104, or the contact area 111*a* may be recessed away from the pin hole 104, which is not limited here.

The contact area 111*a* may be other types of curved surfaces, such as a part of a sphere, or the contact area 111*a* may be a plane.

In another specific embodiment, the avoidance area 111*b* may be a curved surface or a plane. Since the avoidance area 111*b* does not contact with the traction platform of the coupler knuckle, the avoidance area 111*b* may be of any shape as long as a gap is provided between the avoidance area 111*b* and the traction platform of the coupler body after the coupler knuckle is engaged with the coupler body.

In an embodiment, a minimum distance between a connection of the avoidance area 111*b* and the contact area 111*a* and the lock surface 115 is defined as L1, and 60 mm≥L1≥10 mm. That is, the minimum distance L1 refers to the minimum value in the perpendicular distances between all points on the contact area 111*a* and the lock surface 115. In this way, it is ensured that the distance from the engagement contact bearing position of the coupler body and the coupler knuckle to the lock surface 115 is no greater than 60 mm and no less than 10 mm, the distance may be, for example, 12 mm, 15 mm and so on, thus effectively reducing the stress of the traction platforms of the coupler knuckle.

Apparently, the minimum distance L1 between the connection of the avoidance area 111*b* and the contact area 111*a* and the lock surface 115 may be other values according to the actual situation, which is not limited here.

Figure 11:
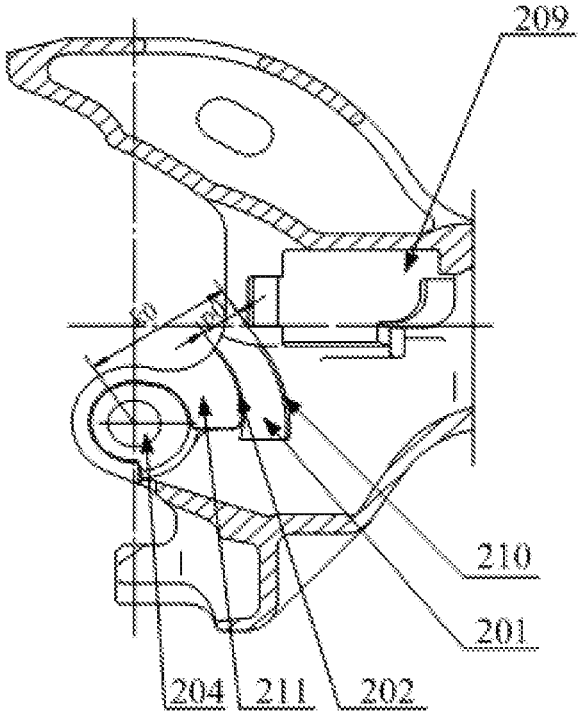
FIG. 11 is a sectional view of a coupler body provided by an embodiment of the present application.
Figure 12:
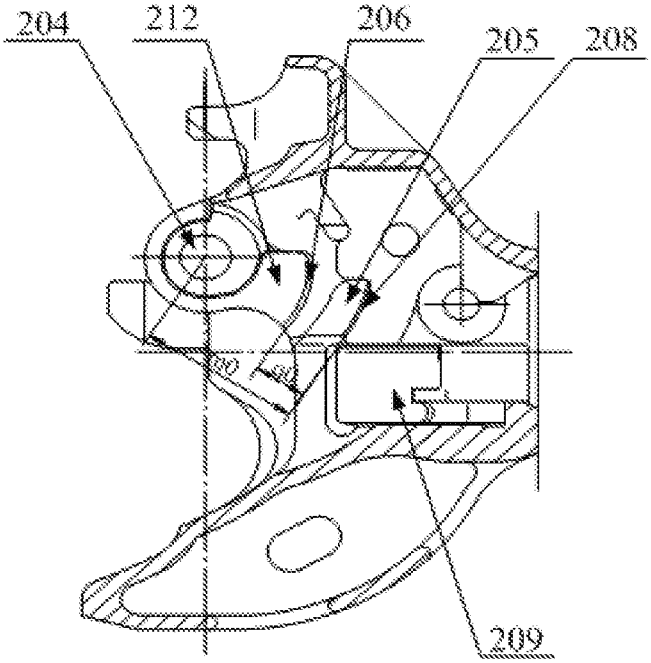
FIG. 12 is another sectional view of the coupler body provided by an embodiment of the present application.
Figure 13:
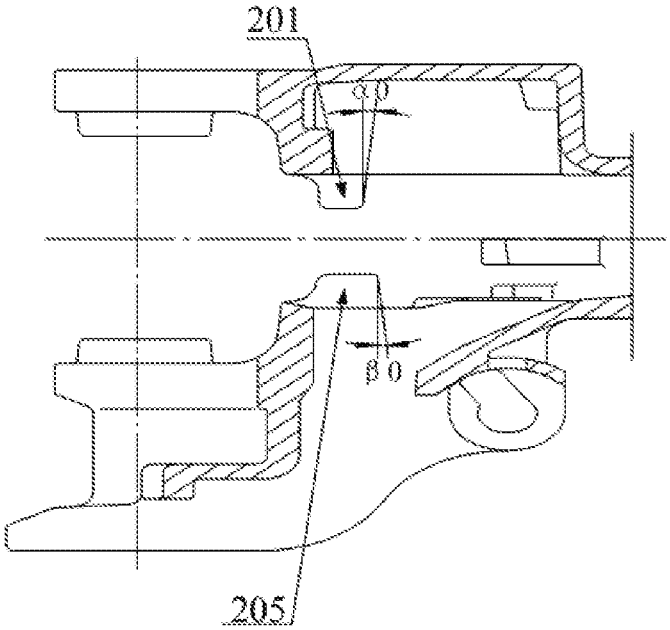
FIG. 13 is a sectional view taken along a vertical plane of the coupler body provided by an embodiment of the present application.
Figure 14:
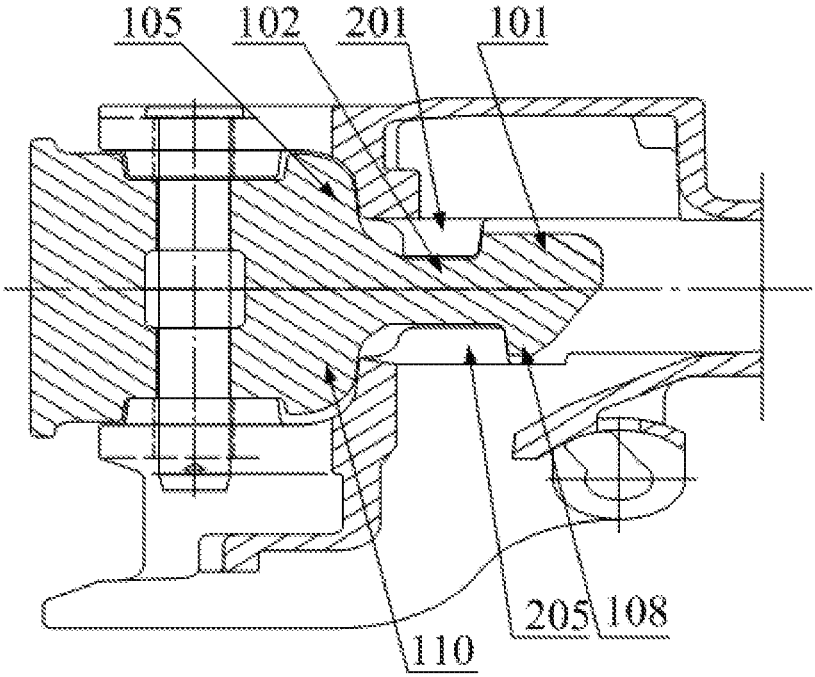
FIG. 14 is a sectional view showing the engagement of the coupler knuckle and the coupler body provided by an embodiment of the present application.
Figure 15:
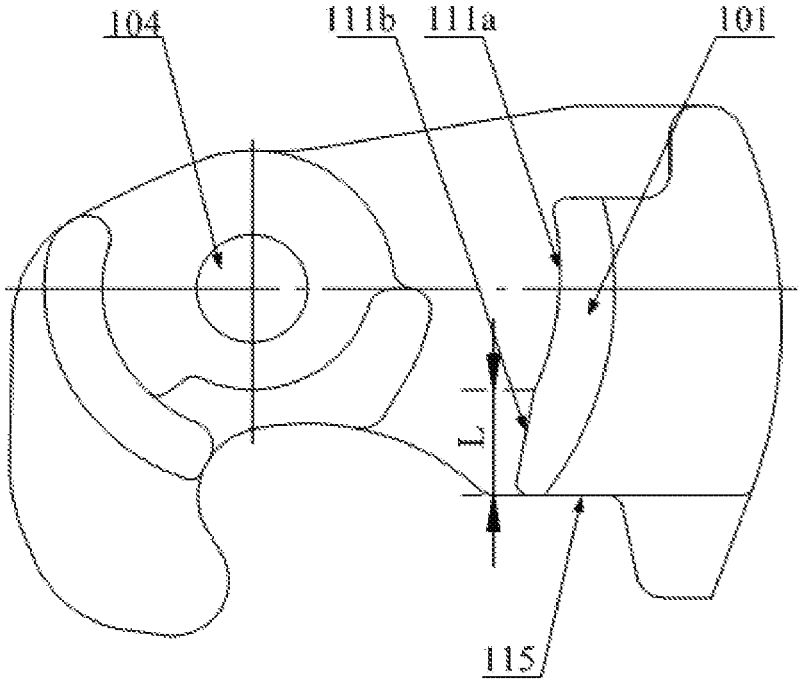
FIG. 15 is a top view of the coupler knuckle provided by an embodiment of the present application.
Figure 16:
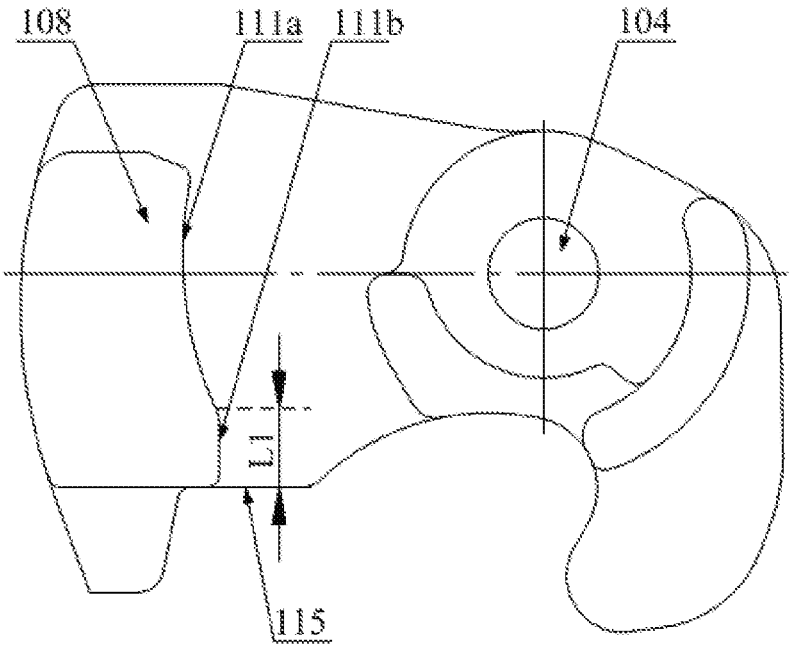
FIG. 16 is a bottom view of the coupler knuckle provided by an embodiment of the present application.
Figure 17:
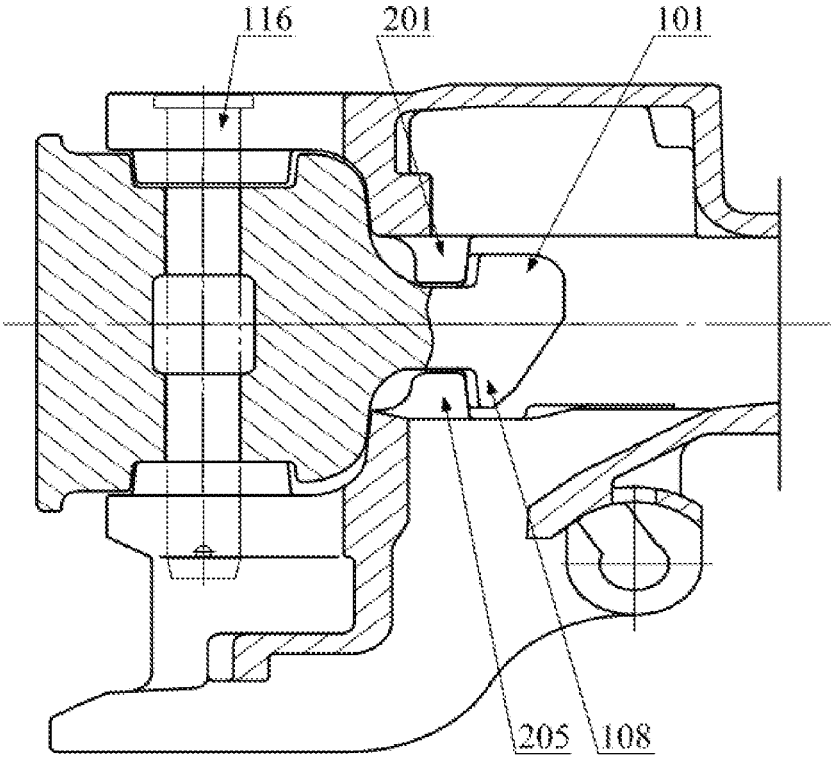
FIG. 17 is a sectional view of an avoidance area provided by an embodiment of the present application.
Figure 18:
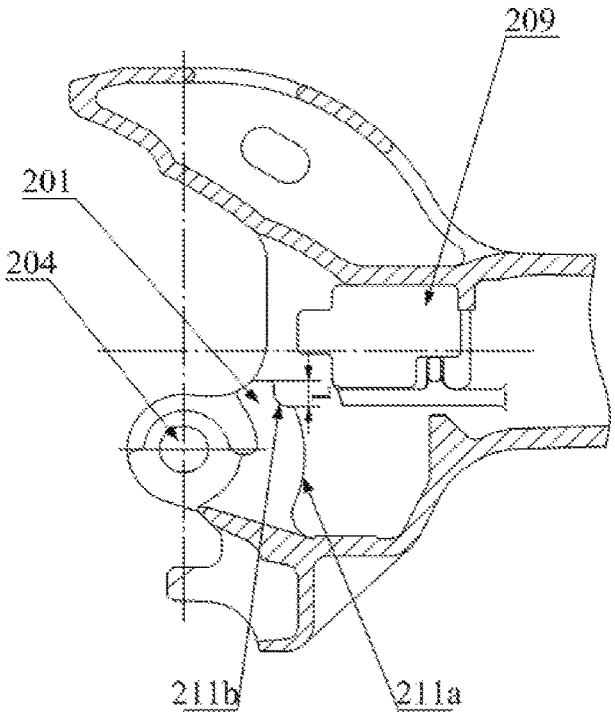
FIG. 18 is a sectional view of a coupler body provided by an embodiment of the present application.
Figure 19:
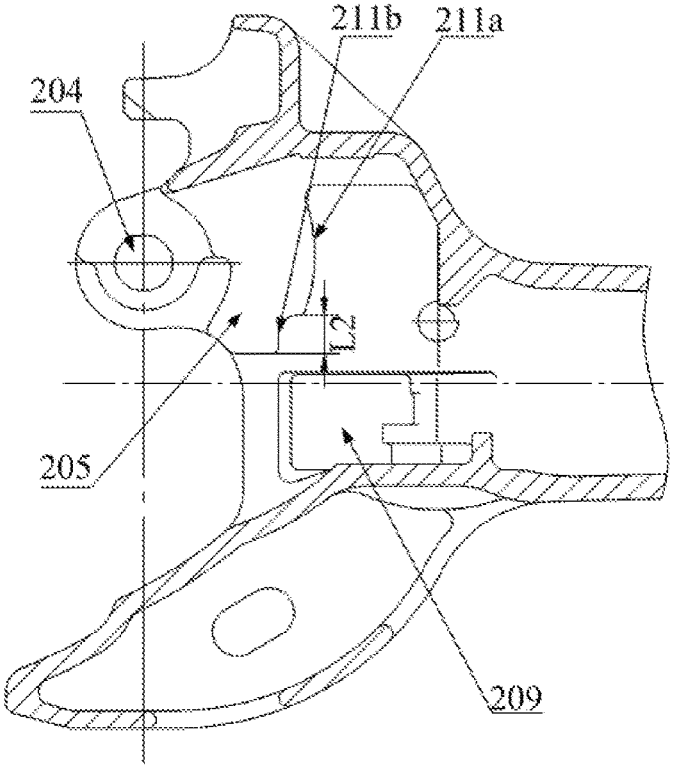
FIG. 19 is another sectional view of the coupler body provided by an embodiment of the present application.

Referring to FIGS. 11 to 13, FIGS. 11 to 13 show the structure of the coupler body. The coupler body provided by the embodiment of the present application includes an upper traction platform 201, a lower traction platform 205, an upper impact platform 211, a lower impact platform 212, a pin hole 204, and a lock chamber 209, wherein the lock chamber 209 is configured to accommodate the coupler lock to enable the coupler knuckle to rotate around the coupler knuckle pin.

The point is that, a section T of a traction surface of the upper traction platform 201 and a section U of a traction surface of the lower traction platform 205 are obtained by sectioning the coupler body along any vertical plane passing through an axis of the pin hole 204, and the section T and section U herein are both lines. The traction surface of the upper traction platform 201 is the upper traction surface 210, and the traction surface of the lower traction platform 205 is the lower traction surface 208. That is, when the coupler knuckle is sectioned along the vertical plane, the vertical plane needs to pass through the axis of the pin hole 204, the upper traction surface 210 and the lower traction surface 208 of the coupler body at the same time so as to obtain the section T and the section U.

A perpendicular distance between a point on the section T farthest from the lower traction platform 205 and the axis of the pin hole 204 is defined as k0, and a perpendicular distance between a point on the section U farthest from the upper traction platform 201 and the axis of the pin hole 204 is defined as m0, and $n0=|k0-m0|$, and $10\ mm \le n0 \le 25\ mm$. The point farthest away from the lower traction platform 205 is the point on the section T with the maximum distance from the lower traction platform 205. The point farthest away from the upper traction platform 201 is the point on the section U with the maximum distance from the upper traction platform 201. It should be noted that, in a case that the upper traction surface 210 and the lower traction surface 208 are connected with other parts of the coupler body through a smooth transition surface, the distance between a joint of the upper traction surface 210 and the smooth transition surface and the lower traction platform 205 is the largest, that is, a connection point of the section T and a section of the smooth transition surface is farthest from to the lower traction platform 205. Similarly, the distance between a joint of the lower traction surface 208 and the smooth transition surface and the upper traction platform 201 is the largest, that is, a connection point of the section U and the section of the smooth transition surface is farthest from the upper traction platform 201.

In the above embodiment, whether $k0>m0$, or $k0<m0$ is applicable, which is not limited herein.

Or, in other words, a perpendicular distance between an upper end point of the section T and the axis of the pin hole 204 is defined as k0, and a perpendicular distance between a lower end point of the section U and the axis of the pin hole 204 is defined as m0, and $n0=|k0-m0|$, and $10\ mm \le n0 \le 25\ mm$. In each embodiment, the upper and lower directions are the same as those during the normal use of the coupler body.

In the coupler body provided by the embodiment of the present application, the upper traction platform 201 and the lower traction platform 205 of the coupler body are misaligned in the horizontal direction, thereby avoiding the situation where roots of the upper traction platform 201 and the lower traction platform 205 of the coupler body are located in the same vertical plane. The roots of the upper traction platform 201 and the lower traction platform 205 are both weak portions in the large stress zone. Therefore, weak portions in the large stress zone of the upper traction platform 201 and the lower traction platform 205 of the coupler knuckle are misaligned, greatly reducing the stress of the upper and lower traction platforms 205. In addition, the misalignment between the upper traction platform 201 and the lower traction platform 205 is within a range of 5 mm to 25 mm, and the misalignment is more reasonable, such that the traction platform and the impact platform are not too close in terms of distance, thus avoiding the deterioration of the stress state of this portion caused by the structural abrupt change between the traction platform and the impact platform of the coupler body. In conclusion, the coupler body provided by the embodiment of the present application can reduce the stress, avoid the problem that the upper and lower traction platforms 205 break prematurely, prolong the service life of the coupler body, reduce the maintenance cost, and improve transportation safety and reliability.

In a specific embodiment, an included angle between the section T and the vertical plane is defined as $\alpha 0$, and $5° \le \alpha 0 \le 15°$. An included angle between the section U and the vertical plane is defined as $\beta 0$, and $5° \le \beta 0 \le 15°$. That is, the upper traction surface 210 and the lower traction surface 208 are inclined relative to the vertical plane. An inclination angle of the upper traction surface 210 relative to the vertical plane is $\alpha 0$, and an inclination angle of the lower traction surface 208 relative to the vertical plane is $\beta 0$. The values of $\alpha 0$ and $\beta 0$ may be the same or different, which will not be limited herein.

Further, the traction surface of the upper traction platform 201 tilts gradually toward the upper impact platform 211 from root to head, that is, the upper traction surface 210 extends gradually away from the upper impact platform 211 in an upward direction. The traction surface of the lower traction platform 205 tilts gradually toward the lower impact platform 212 from root to head, that is, the lower traction surface 208 extends gradually away from the lower impact platform 212 in a downward direction. In the present embodiment, by arranging mating surface angles of the upper traction surface 210 and the lower traction surface 208 of the coupler body more reasonable, the stress level of the upper and lower traction platforms 205 is reduced, the structural strength of the upper and lower traction platforms 205 of the coupler body is improved, the premature fracture of the traction platforms of the coupler body is avoided, and the service life of the coupler knuckle and the coupler body is prolonged.

Apparently, the traction surface of the upper traction platform 201 may tilt gradually away from the upper impact platform 211 from root to head, and the traction surface of the lower traction platform 205 may tilt gradually away from the lower impact platform 212 from root to head. Or, the upper traction surface 210 and the lower traction surface 208 may both be vertical surfaces, which are not limited herein.

It should be noted that the root of the upper and lower traction platforms 205 of the coupler body is an end connected with other parts of the coupler body, and the head of the upper and lower traction platforms 205 of the coupler body is an end opposite to or in contact with the neck portion 102 of the coupler knuckle. When the coupler knuckle is engaged with the coupler body, the neck portion 102 of the coupler knuckle is located between the upper and lower traction platforms 205 of the coupler body.

In an embodiment, a distance in the horizontal direction between one end of the traction surface of the upper traction platform 201 closest to the root of the upper traction platform and one end of the impact surface of the upper impact platform 211 close to the root of the upper traction platform 201 is defined as p1. That is, the projection of the end, closest to the root, of the upper traction surface 210 on the horizontal plane L is a point V0, and the projection of the end, close to the root of the upper traction platform 201, of the upper impact surface 202 on the horizontal plane L is a point W0, and the distance between the point V0 and the point W0 is P1.

A distance in the horizontal direction between one end of the traction surface of the lower traction platform 205 closest to the root of the lower traction platform and one end of the impact surface of the lower impact platform 212 close to the root of the lower traction platform 205 is defined as q1, and p1<q1. That is, the projection of the end, closest to the root, of the lower traction surface 208 on the horizontal plane L is a point X0, and the projection of the end, close to the root of the upper traction platform 201, of the lower impact surface 206 on the horizontal plane L is a point Y0, and the distance between the point X0 and the point Y0 is q1, and p1<q1.

The coupler body provided by the embodiment of the present application includes the upper traction platform 201, the lower traction platform 205, the lock chamber 209 and the pin hole 204, wherein the lock chamber 209 is configured to accommodate the coupler lock to enable the coupler knuckle to rotate around the coupler knuckle pin 116, and the pin hole 204 is configured to allow the coupler knuckle pin 116 to pass through. The point is that the traction surface of the upper traction platform 201 and/or the lower traction platform 205 is divided into an abutting area 211*a* and a non-abutting area 211*b* along a direction of gradually approaching the lock chamber 209. That is, the traction surface of at least one of the upper traction platform 201 and the lower traction platform 205 is divided into the abutting area 211*a* and the non-abutting area 211*b*, and the non-abutting area 211*b* is closer to the lock chamber 209 than the abutting area 211*a*, that is, the traction surface is sequentially divided into the abutting area 211*a* and the non-abutting area 211*b* along the direction of gradually approaching the lock chamber 209.

In addition, an extension surface of one end of the abutting area 211*a* close to the lock chamber 209 is defined as M2, and the non-abutting area 211*b* is located on one side of the M2 surface close to the pin hole 204. If a first end of the abutting area 211*a* is connected with the non-abutting area 211*b*, the M2 surface is the extension surface of the first end of the abutting area 211*a*, and the non-abutting area 211*b* is located between the M2 surface and the pin hole 204. When the coupler body is in normal use, a section of the M2 surface, a section of the abutting area 211*a* and a section of the non-abutting area 211*b* are obtained by sectioning the coupler body along the horizontal plane. The section of the M2 surface is an extension line of the section of the abutting area 211*a*, and the section of the non-abutting area 211*b* is located between the section of the M2 surface and a section of the pin hole 204.

It should be noted that the above-mentioned pin hole 204 and the lock chamber 209 are the same as those of the coupler body in the prior art. The pin hole 204 is located at the front side of the coupler body, and the front side of the coupler body is configured to engage with the coupler knuckle.

When the coupler body provided by the embodiment of the present application is engaged with the coupler knuckle, the traction surface of the upper traction platform 201 of the coupler body contacts and abuts against the traction surface of the upper traction platform 101 of the coupler knuckle, and the traction surface of the lower traction platform 205 of the coupler body contacts and abuts against the traction surface of the lower traction platform 108 of the coupler knuckle, and the traction platform of the coupler body is located at one side of the corresponding traction platform of the coupler knuckle close to the pin hole 204. As the upper traction platform 201 and/or the lower traction platform 205 of the coupler body is provided with the non-abutting area 211*b* which is located at one side of the extension surface of the abutting area 211*a* close to the pin hole 204, a gap is provided between the non-abutting area 211*b* of the traction surface of the upper traction platform 201 and/or the lower traction platform 205 of the coupler body and the traction surface of the corresponding traction platform of the coupler knuckle, and the non-abutting area and the traction surface of the corresponding traction platform of the coupler knuckle cannot contact each other, when the coupler body provided by the embodiment of the present application is engaged with the coupler knuckle. Meanwhile, the abutting area 211*a* of the traction surface of the upper traction platform 201 and/or the lower traction platform 205 of the coupler body and the traction surface of the corresponding traction platform of the coupler knuckle are in close contact with each other without a gap.

With this arrangement, since the non-abutting area 211*b* is located at one side of the abutting area 211*a* close to the lock chamber 209 and a gap is provided between the non-abutting area 211*b* and the traction platform of the coupler knuckle and the two are not in contact with each other, the distance from the edge of the contact area between the upper traction platform 201 and/or the lower traction platform 205 of the coupler body and the traction platform of the coupler knuckle to the lock chamber 209 is increased, and the distance from the engagement contact bearing position of the coupler body and the coupler knuckle to the lock chamber 209 and the lock surface is increased, so that the engagement contact bearing position of the coupler body and the coupler knuckle gets away from the structural abrupt change area, thereby reducing the stress level of the upper and lower traction platforms of the coupler body and the coupler knuckle, avoiding the problem that the traction platforms of the coupler body and the coupler knuckle break prematurely, prolonging the service life of the coupler body and the coupler knuckle, and reducing the maintenance cost of the coupler.

In a specific embodiment, the first end of the non-abutting area 211*b* is connected with the abutting area 211*a* and the second end of the non-abutting area is away from the abutting area, that is, two ends of the non-abutting area 211*b* are respectively defined as the first end and the second end along the direction of approaching the lock chamber 209, wherein the first end is connected with the abutting area 211*a*, and the second end is farther away from the abutting area 211*a* than the first end. The front side of the coupler body is configured to engage with the coupler knuckle, and the rear side of the coupler body is configured to engage and connect with the vehicle. When the coupler body is in normal use, the left and right sides of the coupler body coincide with the left and right sides of the vehicle, that is, the coupler body is perpendicular to the traveling direction of the vehicle along the direction from left to right. The direction from left to right and perpendicular to the axis of the pin hole is defined as the first extension direction of the coupler body. An extension distance from the first end to the second end of the non-abutting area 211*b* along the first extension direction is defined as L2, and L2>10 mm. In this way, it is ensured that the distance from the engagement contact bearing position of the coupler body and the coupler knuckle to the lock chamber 209 is greater than 10 mm, the distance may be, for example, 12 mm, 15 mm and so on, thus effectively reducing the stress of the traction platforms of the coupler body. Specifically, extension distances from different positions of the first end of the non-abutting area 211*b* to different positions of the second end along the first extension direction are all L2.

Apparently, the extension distance L2 from the first end to the second end of the non-abutting area 211*b* along the first extension direction may be other values according to the actual situation, which is not limited here.

In order to prevent dislocation when the coupler body is engaged with the coupler knuckle, the abutting area 211*a* may be a curved surface, and similarly, the area, cooperating with the abutting area, on the traction surface of the traction platform of the coupler knuckle may be a curved surface as well. The coupler body and the coupler knuckle can be prevented from sliding relative to each other and from shifting and dislocation.

In addition, the abutting area 211*a* may be an arc surface. Specifically, the abutting area 211*a* may protrude away from the pin hole 204, or the abutting area 211*a* may protrude toward the pin hole 204, which is not limited here.

The abutting area 211*a* may be other types of curved surfaces, such as a part of a sphere, or the abutting area 211*a* may be a plane.

In an embodiment, the non-abutting area 211*b* is specifically an inner wall of a groove provided on the traction surface of the upper traction platform 201 and/or the lower traction platform 205. In this way, it is applicable by directly providing a groove on the traction surface of the upper traction platform 201 and/or the lower traction platform 205, and the operation is simpler and more convenient.

In another specific embodiment, the non-abutting area 211*b* may be a curved surface. Since the non-abutting area 211*b* does not contact with the traction platform of the coupler knuckle, the non-abutting area 211*b* 111*b* may be of any shape as long as a gap is provided between the non-abutting area 211*b* and the traction platform of the coupler knuckle after the coupler body is engaged with the coupler knuckle.

Apparently, the non-abutting area 211*b* 111*b* may be an arc surface or a plane, which is not limited here.

Based on the above embodiments, a coupler is further provided according to the embodiments of the present application, which includes a coupler knuckle and a coupler body, wherein the coupler knuckle is the coupler knuckle described in any one of the above embodiments, and the coupler body is the coupler body described in any one of the above embodiments. Since the coupler knuckle and the coupler body according to the above embodiments are adopted in the coupler, the coupler has the same beneficial effect as the coupler body and the coupler knuckle according to the above embodiments.

In the present specification, the embodiments are described in a progressive manner. Each embodiment mainly focuses on an aspect different from other embodiments, and reference can be made to these similar parts among the embodiments.

The above illustration of the disclosed embodiments can enable those skilled in the art to implement or use the present application. Various modifications to the embodiments are apparent to the person skilled in the art, and the general principle herein can be implemented in other embodiments without departing from the spirit or scope of the present application. Hence, the present application is not limited to the embodiments disclosed herein, but is to conform to the widest scope in accordance with the principles and novel features disclosed herein.

The invention claimed is:

1. A coupler knuckle comprising an upper traction platform, a lower traction platform, an upper impact platform, a lower impact platform, a pin hole and a neck portion, wherein a section R of a traction surface of the upper traction platform and a section S of a traction surface of the lower traction platform are obtained by sectioning the coupler knuckle along any vertical plane passing through an axis of the pin hole; and a perpendicular distance between a point on the section R closest to the neck portion and the axis of the pin hole is defined as k, and a perpendicular distance between a point on the section S closest to the neck portion and the axis of the pin hole is defined as m, and $n=|k-m|$ and $10\ mm \leq n \leq 25\ mm$.

2. The coupler knuckle according to claim 1, wherein an included angle between the section R and the vertical plane is defined as a, and $5° \leq \alpha \leq 15°$; and an included angle between the section S and the vertical plane is defined as (3, and 5°<(3<15°.

3. The coupler knuckle according to claim 2, wherein the traction surface of the upper traction platform tilts away from the upper impact platform in a direction gradually away from the neck portion; and the traction surface of the lower traction platform tilts away from the lower impact platform in a direction gradually away from the neck portion.

4. The coupler knuckle according to claim 1, wherein a distance in a horizontal direction between a point on the traction surface of the upper traction platform closest to a coupler tip and closest to the neck portion and a point on an impact surface of the upper impact platform closest to the coupler tip and closest to the neck portion is defined as p; and a distance in the horizontal direction between a point on the traction surface of the lower traction platform closest to the coupler tip and closest to the neck portion and a point on the impact surface of the lower impact platform closest to the coupler tip and closest to the neck portion is defined as q, and $p<q$.

5. The coupler knuckle according to claim 1, wherein the traction surface of the upper traction platform and/or the traction surface of the lower traction platform is divided into a contact area and an avoidance area along a direction of approaching a lock surface of the coupler knuckle, an extension surface of one end of the contact area close to the lock surface is defined as M1, and the avoidance area is located on one side of the M1 surface away from the pin hole.

6. A coupler body comprising an upper traction platform, a lower traction platform, an upper impact platform, a lower impact platform, a pin hole and a lock chamber, wherein a section T of a traction surface of the upper traction platform and a section U of a traction surface of the lower traction platform are obtained by sectioning the coupler body along any vertical plane passing through an axis of the pin hole; and a perpendicular distance between a point on the section T farthest from the lower traction platform and the axis of the pin hole is defined as k0, and a perpendicular distance between a point on the section U farthest from the upper traction platform and the axis of the pin hole is defined as m0, and n0=1k0−m01, and 10 mm≤n0≤25 mm.

7. The coupler body according to claim 6, wherein an included angle between the section T and the vertical plane is defined as α0, and 5°≤α0≤15°; and an included angle between the section U and the vertical plane is defined as (30, and 5°≤β0≤15°.

8. The coupler body according to claim 6, wherein a distance in a horizontal direction between one end of the traction surface of the upper traction platform closest to the root of the upper traction platform and one end of the impact surface of the upper impact platform close to the root of the upper traction platform is defined as p1; and a distance in the horizontal direction between one end of the traction surface of the lower traction platform closest to the root of the lower traction platform and one end of the impact surface of the lower impact platform close to the root of the lower traction platform is defined as q1, and p1<q1.

9. The coupler body according to claim 6, wherein the traction surface of the upper traction platform and/or the traction surface of the lower traction platform is divided into an abutting area and a non-abutting area along a direction of approaching the lock chamber of the coupler body, an extension surface of one end of the abutting area close to the lock chamber is defined as M2, and the non-abutting area is located on one side of the M2 surface close to the pin hole.

10. A coupler, comprising a coupler knuckle and a coupler body, wherein the coupler knuckle comprises an upper traction platform of the coupler knuckle, a lower traction platform of the coupler knuckle, an upper impact platform of the coupler knuckle, a lower impact platform of the coupler knuckle, a pin hole of the coupler knuckle and a neck portion, wherein a section R of a traction surface of the upper traction platform of the coupler knuckle and a section S of a traction surface of the lower traction platform of the coupler knuckle are obtained by sectioning the coupler knuckle along any vertical plane passing through an axis of the pin hole of the coupler knuckle; and a perpendicular distance between a point on the section R closest to the neck portion and the axis of the pin hole of the coupler knuckle is defined as k, and a perpendicular distance between a point on the section S closest to the neck portion and the axis of the pin hole of the coupler knuckle is defined as m, and n=|k−m|, and 10 mm≤n≤25 mm; and, the coupler body comprise:

an upper traction platform of the coupler body, a lower traction platform of the coupler body, an upper impact platform of the coupler body, a lower impact platform of the coupler body, a pin hole of the coupler body and a lock chamber, wherein a section T of a traction surface of the upper traction platform of the coupler body and a section U of a traction surface of the lower traction platform of the coupler body are obtained by sectioning the coupler body along any vertical plane passing through an axis of the pin hole of the coupler body; and a perpendicular distance between a point on the section T farthest from the lower traction platform of the coupler body and the axis of the pin hole of the coupler body is defined as k0, and a perpendicular distance between a point on the section U farthest from the upper traction platform of the coupler body and the axis of the pin hole of the coupler body is defined as m0, and n0=1k0−m01, and 10 mm≤n0≤25 mm.

* * * * *